US009544980B2

(12) United States Patent
Chou et al.

(10) Patent No.: US 9,544,980 B2
(45) Date of Patent: Jan. 10, 2017

(54) DRIVING DEVICE AND ILLUMINATION SYSTEM

(71) Applicant: DELTA ELECTRONICS, INC., Taoyuan (TW)

(72) Inventors: Ching Ho Chou, Taoyuan (TW); Yung Chuan Lu, Taoyuan (TW); Yen Yu Chen, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 14/850,251

(22) Filed: Sep. 10, 2015

(65) Prior Publication Data

US 2016/0205755 A1 Jul. 14, 2016

(30) Foreign Application Priority Data

Jan. 8, 2015 (TW) ..... 104100487 A

(51) Int. Cl.

| | |
|---|---|
| ***H05B 41/08*** | (2006.01) |
| ***H05B 41/295*** | (2006.01) |
| ***H05B 41/24*** | (2006.01) |
| ***H05B 41/298*** | (2006.01) |

(52) U.S. Cl.

CPC ..... *H05B 41/295* (2013.01); *H05B 41/24* (2013.01); *H05B 41/245* (2013.01); *H05B 41/2983* (2013.01)

(58) Field of Classification Search

CPC ..... H05B 41/24; H05B 41/245; H05B 41/295; H05B 41/2983

See application file for complete search history.

(56) References Cited

U.S. PATENT DOCUMENTS

| | | | | |
|---|---|---|---|---|
| 5,650,925 | A * | 7/1997 | Hesterman | H02M 1/4225 363/132 |
| 7,247,991 | B2 * | 7/2007 | Chen | H05B 41/295 315/106 |
| 7,329,997 | B1 * | 2/2008 | McElroy | C01B 13/115 315/291 |
| 7,999,784 | B2 * | 8/2011 | Moon | G02F 1/133604 315/209 R |
| 2008/0143274 | A1 * | 6/2008 | Itou | H05B 33/0815 315/307 |
| 2009/0273299 | A1 * | 11/2009 | Gawrys | H05B 41/295 315/268 |

(Continued)

*Primary Examiner* — Jason M Crawford
*Assistant Examiner* — Kurtis R Bahr
(74) *Attorney, Agent, or Firm* — Muncy, Geissler, Olds & Lowe, P.C.

(57) ABSTRACT

A driving device provides output power to an illumination device including a plurality of filaments is provided. A first converting module converts input power into direct current (DC) power. The first converting module includes a pair of first input terminals receiving the input power and a pair of first output terminals coupled to a first node and a second node and outputting the DC power. A first capacitor is coupled between the first node and a third node. A second capacitor is coupled between the second and third nodes. The first clamping module is connected to a first specific capacitor in parallel. The first specific capacitor is the first capacitor or the second capacitor. A second converting module converts the DC power to generate the output power.

16 Claims, 6 Drawing Sheets

(56) References Cited

U.S. PATENT DOCUMENTS

2012/0249012 A1* 10/2012 Xu ..... H05B 33/0815
315/291
2012/0313527 A1* 12/2012 Zhang ..... H05B 41/295
315/116

* cited by examiner

DRIVING DEVICE AND ILLUMINATION SYSTEM

CROSS REFERENCE TO RELATED APPLICATIONS

This Application claims priority of Taiwan Patent Application No. 104100487, filed on Jan. 8, 2015, the entirety of which is incorporated by reference herein.

BACKGROUND OF THE INVENTION

Field of the Invention

The invention relates to a driving device, and more particularly to a driving device to light an illumination device.

Description of the Related Art

Illumination is a base requirement for people. In recent years, economic and trade activities and business activities are frequently held, and quality of home life is increased. The amount of electricity required for illumination is increased. Therefore, the power consumption of illumination is appreciable. Low-voltage, gas-discharge lamps are used widely. These lamps are referred to as fluorescent lamps.

BRIEF SUMMARY OF THE INVENTION

In accordance with an embodiment, a driving device provides output power to an illumination device comprising a plurality of filaments and comprises a first converting module, a first capacitor, a second capacitor, a first clamping module, and a second converting module. The first converting module converts input power into direct current (DC) power. The first converting module comprises a pair of first input terminals receiving the input power and a pair of first output terminals coupled to a first node and a second node and outputting the DC power. The first capacitor is coupled between the first node and a third node. The second capacitor is coupled between the second and third nodes. The first clamping module is connected to a first specific capacitor in parallel. The first specific capacitor is the first capacitor or the second capacitor. The second converting module converts the DC power to generate the output power. The second converting module comprises a second input terminal pair coupled to the first and second nodes and a second output terminal pair outputting the output power to turn on the illumination device.

In accordance with another embodiment, an illumination system comprises a first illumination device, a first converting module, a first capacitor, a second capacitor, a first clamping module, and a second converting module. The first illumination device comprises a plurality of filaments. The first illumination device is turned on according to output power. The first converting module converts input power into direct current (DC) power. The first converting module comprises a pair of first input terminals receiving the input power and a pair of first output terminals coupled to a first node and a second node and outputting the DC power. The first capacitor is coupled between the first node and a third node. The second capacitor is coupled between the second and third nodes. The first clamping module is connected to a first specific capacitor in parallel. The first specific capacitor is the first capacitor or the second capacitor. The second converting module converts the DC power to generate the output power. The second converting module comprises a second input terminal pair coupled to the first and second nodes and a second output terminal pair outputting the output power to turn on the illumination device.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
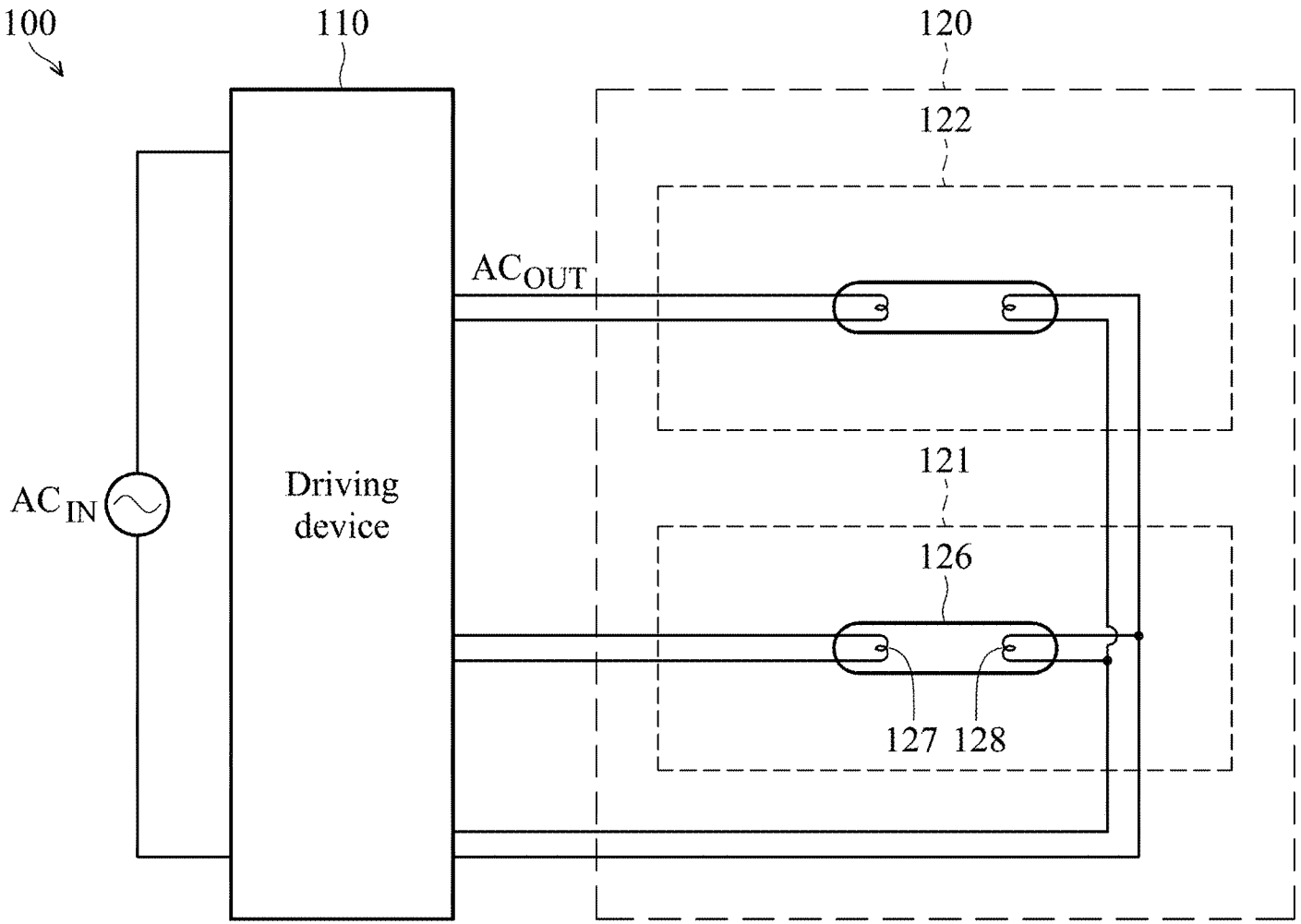
FIGS. 1 and 5 are schematic diagrams of exemplary embodiments of an illumination system, in accordance with some embodiments.

FIG. 1 is a schematic diagram of an exemplary embodiment of an illumination system, in accordance with some embodiments. The illumination system 100 comprises a driving device 110 and a load 120. The driving device 110 generates output power $AC_{OUT}$ to drive the load 120 according to input power $AC_{IN}$. In this embodiment, the load 120 comprises illumination devices 121 and 122, but the disclosure is not limited thereto. In some embodiments, the load 120 may comprise one or more illumination devices. The illumination devices 121 and 122 are continuously turned on according to the output power $AC_{OUT}$.

As shown in FIG. 1, the illumination devices 121 and 122 are connected to the driving device 110 in parallel and are capable of operating independently. For example, when the illumination device 121 fails or is removed from the illumination system 100, when the driving device 110 continuously provides the output power $AC_{OUT}$, the illumination device 122 can be turned on. Similarly, when the illumination device 122 fails or is removed from the illumination system 100, the illumination device 121 can be turned on.

Since the operation of each illumination device 121 and 122 is the same, the illumination device 121 is used herein as an example. As shown in FIG. 1, the illumination device 121 is a light tube 126 comprising filaments 127 and 128. In one embodiment, before the driving device 100 provides the output power, the driving device 110 first preheats the filaments 127 and 128 to help the illumination device 121 to generate free electrons easily. Furthermore, when the light tube 126 is preheated, a light voltage across the light tube 126 can be reduced and the lift time of the light tube 126 can be increased. Therefore, before providing the output power $AC_{OUT}$, the driving device 110 is capable of turning on the illumination device 121 quickly. In another embodiment, the driving device 110 does not preheat the illumination device 121 but directly provides the output power $AC_{OUT}$. In this case, the illumination device 121 receives the output power $AC_{OUT}$ to turn on. The invention does not limit the type of illumination device. In some embodiments, the illumination devices are bulbs. In one embodiment, the driving device 110 is capable of serving an electronic ballast having a filament-heating apparatus.

Figure 2:
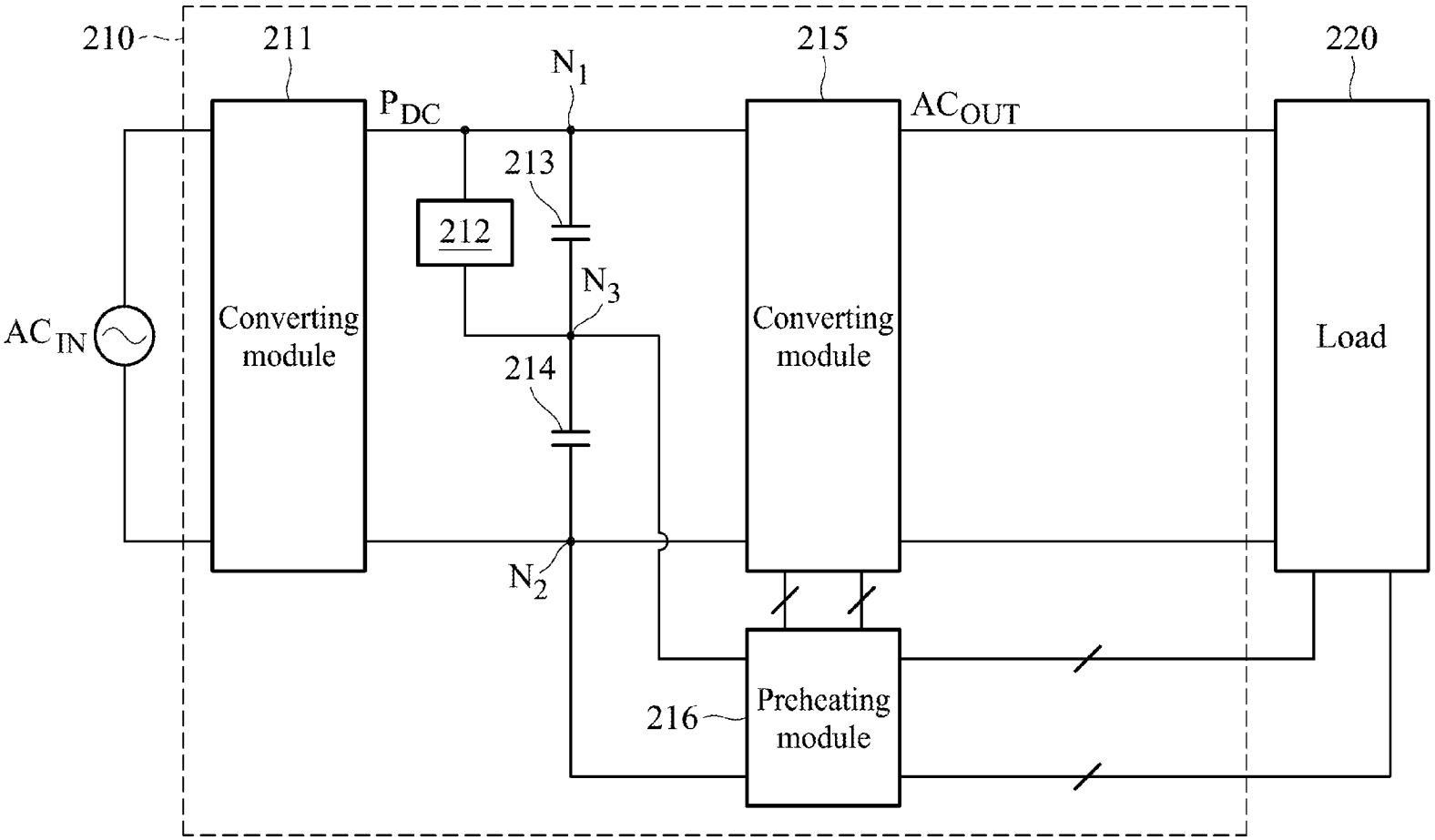
FIGS. 2-3 and 6 schematic diagrams of exemplary embodiments of a driving device, in accordance with some embodiments.

FIG. 2 is a schematic diagram of an exemplary embodiment of a driving device, in accordance with some embodiments. The driving device 210 comprises converting modules 211 and 215, capacitors 213 and 214, a clamping module 212, and a preheating module 216. The converting module 211 converts the input power $AC_{IN}$ into a direct current (DC) power $P_{DC}$. In this embodiment, the converting module 211 comprises a pair of input terminals receiving the input power $AC_{IN}$. The converting module 211 comprises a pair of output terminals coupled to the nodes $N_1$ and $N_2$. In one embodiment, the input power $AC_{IN}$ is an alternating current (AC) power and the peak-to-peak value of the AC power is approximately 347V. After the converting module 211 converts the AC power, the voltage level of the DC power $P_{DC}$ is approximately 560V. In one embodiment, the converting module 211 is an AC-DC converter to convert AC power having a low frequency to DC power having a high frequency. In another embodiment, the converting module 211 has a power factor correction (PFC) function.

The capacitors 213 and 214 are serially connected between the nodes $N_1$ and $N_2$. As shown in FIG. 2, the capacitor 213 is coupled between the nodes $N_1$ and $N_3$. The capacitor 214 is coupled between the nodes $N_3$ and $N_2$. In this embodiment, the capacitance values of the capacitors 213 and 214 are micro-farad. In one embodiment, the capacitance values of the capacitors 213 and 214 are higher than 22 uF. In other embodiment, the capacitors 213 and 214 are integrated into the converting module 211. In some embodiments, if the converting module 211 originally has two capacitors connected between the nodes $N_1$ and $N_2$ in series, the capacitors 213 and 214 can be omitted.

The clamping module 212 is connected to the capacitor 213 or 214 in parallel to clamp the voltage across the capacitor 213 or 214. In this embodiment, the clamping module 212 is connected to the capacitor 213 in parallel to clamp the voltage of the capacitor 213 and provides a charging path for the capacitor 214. The invention does not limit the type of clamping module 212. Any element or circuit can serve as the clamping module 212, as long as the element or circuit is capable of clamping a voltage. In one embodiment, the clamping module 212 is a transient voltage suppressor (TVS), a surge absorber, or a metal oxide varistor (MOV). In some embodiments, if the converting module 211 originally has two capacitors connected between the nodes $N_1$ and $N_2$ in series, the clamping module 212 is connected to one of the capacitors in parallel.

The converting module 215 converts the DC power $P_{DC}$ to generate the output power $AC_{OUT}$. As shown in FIG. 2, the pair of the input terminals of the converting module 215 is coupled to the nodes $N_1$ and $N_2$ to receive the DC power $P_{DC}$. The pair of the output terminals of the converting module 215 provides the output power $AC_{OUT}$ to light the load 220. Since the internal structure of the load 220 is the same as that of the load 120, the description of the load 220 is omitted. In this embodiment, the converting module 215 is a DC-AC converter to convert DC power with high voltage level to AC power with a high frequency.

The preheating module 216 is connected to the capacitor 213 or 214 in parallel. In this embodiment, since the clamping module 212 is connected to the capacitor 213 in parallel, the preheating module 216 is connected to the capacitor 214 in parallel. The preheating module 216 transfers the energy stored in the capacitor 214 to provide preheating energy to preheat the filament of the load 220. When the preheating module 216 captures the energy stored in the capacitor 214, since the clamping module 212 limits the voltage of the capacitor 213, the voltage across the capacitor 213 is not too high. Therefore, a designer does not need to utilize a high voltage capacitor to serve as the capacitor 213.

For example, assuming that the voltage level of the DC power $P_{DC}$ is approximately 560V: Since the capacitor 213 is connected to the capacitor 214 in series, the capacitors 213 and 214 are charged, and the voltages of the capacitors 213 and 214 are approximately 280V. When the energy stored in the capacitor 214 is transferred to the preheating module 216, since the voltage across the capacitor 214 is too low, the capacitor 213 is charged. However, the clamping module 212 limits the voltage across the capacitor 213. In one embodiment, when the voltage across the capacitor 213 exceeds 300V, the clamping module 212 starts operating to stop charging the capacitor 213. At this time, the clamping module 212 provides a charging path to charge the capacitor 214. Therefore, the voltage of the capacitor 213 is not too high, and the voltage of the capacitor 214 can quickly be charged to 280V to supply the preheating module 216. Since the voltages across the capacitors 213 and 214 are controlled, the voltages of the capacitors 213 and 214 are maintained.

Additionally, when the voltage of the capacitor 213 does not reach the turn-on voltage (e.g. 300V) of the clamping module 212, the clamping module 212 does not operate. Therefore, there is no power consumption. Furthermore, the voltages of the capacitors 213 and 214 are controlled by the clamping module 212 such that capacitors pressuring high voltage are not required to serve as the capacitors 213 and 214. Therefore, the cost of elements is reduced.

Figure 3:
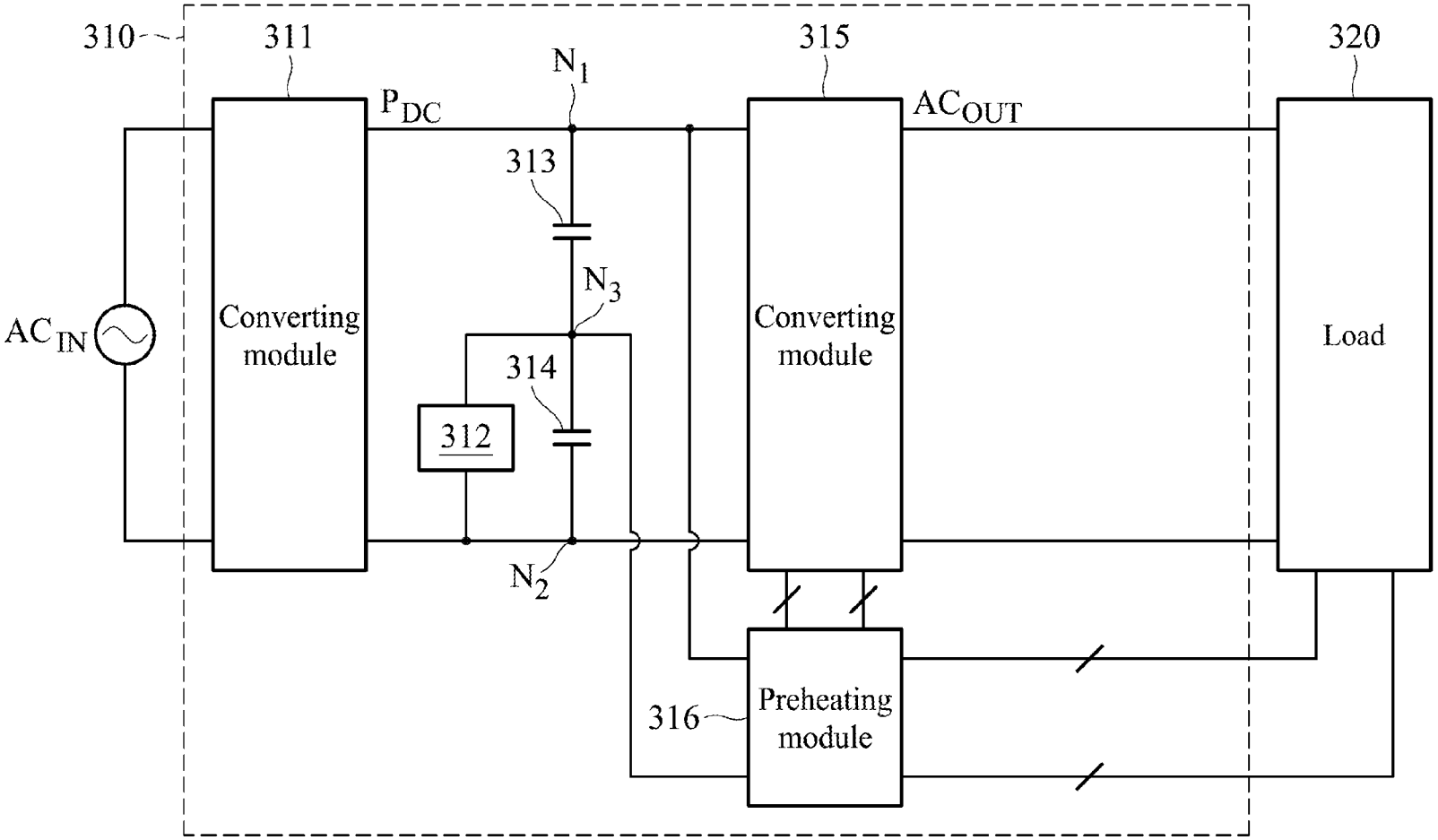

FIG. 3 is a schematic diagram of an exemplary embodiment of a driving device, in accordance with some embodiments. FIG. 3 is similar to FIG. 2 with the exception of the connections of the clamping module 312 and the preheating module 316. Since the operations of the converting modules 311 and 315 are the same as those of the converting modules 211 and 215 shown in FIG. 2, the descriptions of the converting modules 311 and 315 are omitted.

In this embodiment, the clamping module 312 is connected to the capacitor 314 in parallel to clamp the voltage of the capacitor 314. When the voltage of the capacitor 314 reaches a clamping level, the clamping module 312 starts working to maintain the voltage of the capacitor 314 in the clamping level. In addition, the preheating module 316 is connected to the capacitor 313 in parallel to captures the energy stored in the capacitor 313 and transfer the energy to the filaments (not shown) of the load 320.

When the voltage of the capacitor 313 reaches a predetermined level, the preheating module 316 captures the energy stored in the capacitor 313 and transforms the energy to a preheating energy to preheat the filaments of the load 320. At this time, the voltage of the capacitor 313 is reduced. However, the clamping module 312 limits the voltage of the capacitor 314 to avoid the voltage of the capacitor 314 being too high. Therefore, the voltage of the capacitor 314 is maintained at a stable voltage to provide a stable heating energy.

Furthermore, when the preheating module 316 does not transfer energy to the load 320, the voltages of the capacitors 313 and 314 are not changed. Therefore, the clamping module 312 stops working, and there is no power consumption. In one embodiment, the clamping module 312 is a TVS, a surge absorber, or a MOV.

Figure 4:
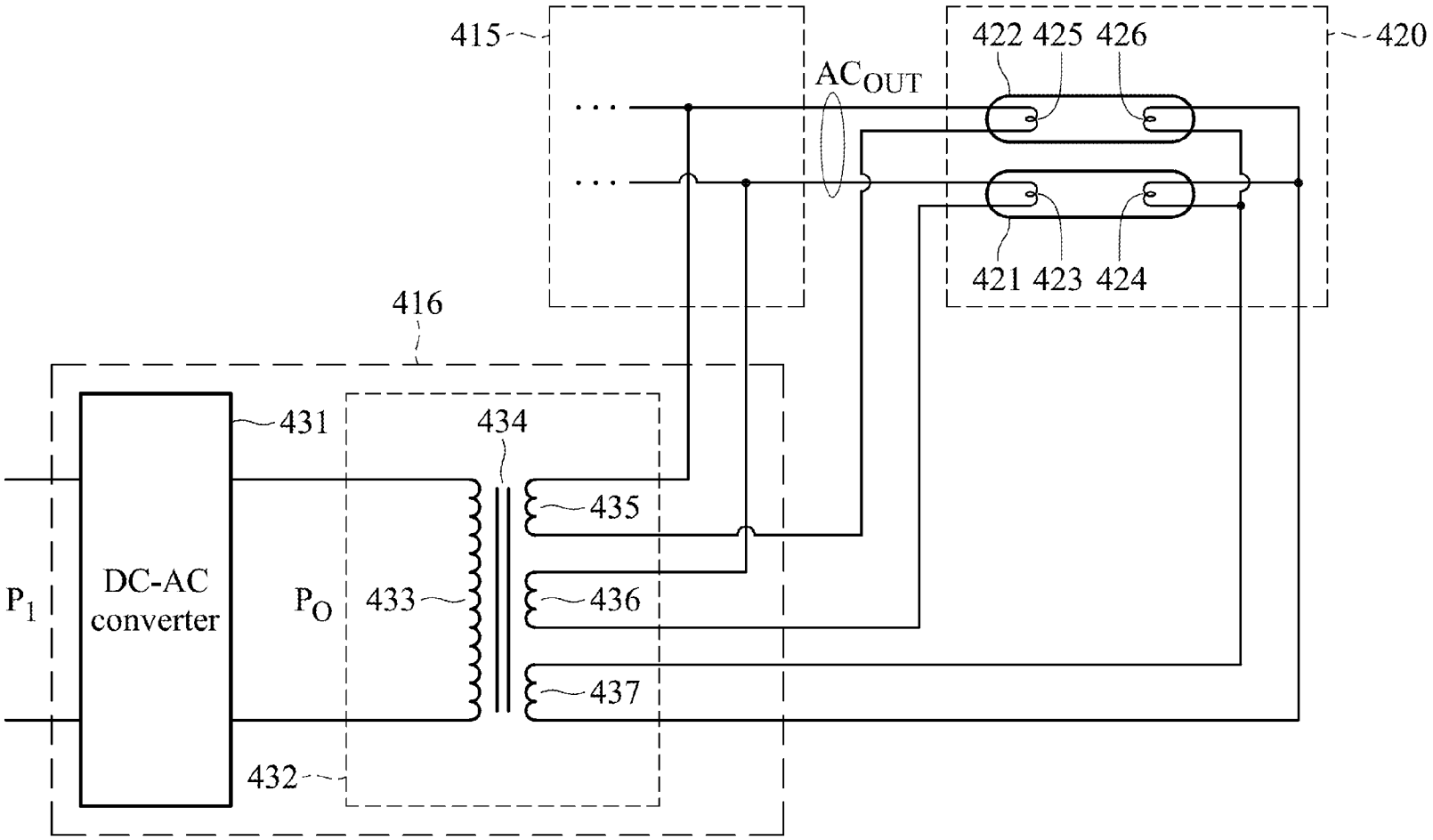
FIG. 4 is a schematic diagram of an exemplary embodiment of a connection among a converting module, a preheating module and a load, in accordance with some embodiments.

FIG. 4 is a schematic diagram of an exemplary embodiment of a connection among a converting module, a preheating module and a load, in accordance with some embodiments. As shown in FIG. 4, the preheating module 416 comprises a DC-AC converter 431 and an isolation transformer 432. The DC-AC converter 431 captures and converts input energy $P_I$ to generate output energy $P_O$. In this embodiment, the input energy $P_I$ is provided by a capacitor. Taking FIG. 2 as an example, the input energy $P_I$ is the energy stored in the capacitor 214.

The isolation transformer 432 comprises a primary winding 433, a magnetic core 434, and secondary windings 435~437. The primary winding 433 is coupled to the DC-AC converter 431 to receive the output energy $P_O$. The secondary winding 435 is coupled to two ends of the filament 425 to preheat the filament 425. The secondary winding 436 is coupled to two ends of the filament 421 to preheat the filament 421. The secondary winding 437 is coupled to two ends of the filaments 424 and 426 to preheat the filaments 424 and 426.

When the primary winding 433 receives the output energy $P_O$, the secondary windings 435~437 generate preheating energy to preheat the filaments 423-426. When the converting module 415 provides the output power $AC_{OUT}$, the light tubes 421 and 422 are lighted quickly. Since the converting module 415 is the same as the converting module 215 or 315, the description of the converting module 415 is omitted.

In one embodiment, the preheating module 416 operates temporarily, such as for 0.5 sec. After preheating the filaments 423~426, the preheating module 416 stops operating. At this time, when the converting module 415 provides the output power $AC_{OUT}$, the light tubes 421 and 422 are lighted quickly.

Figure 5:
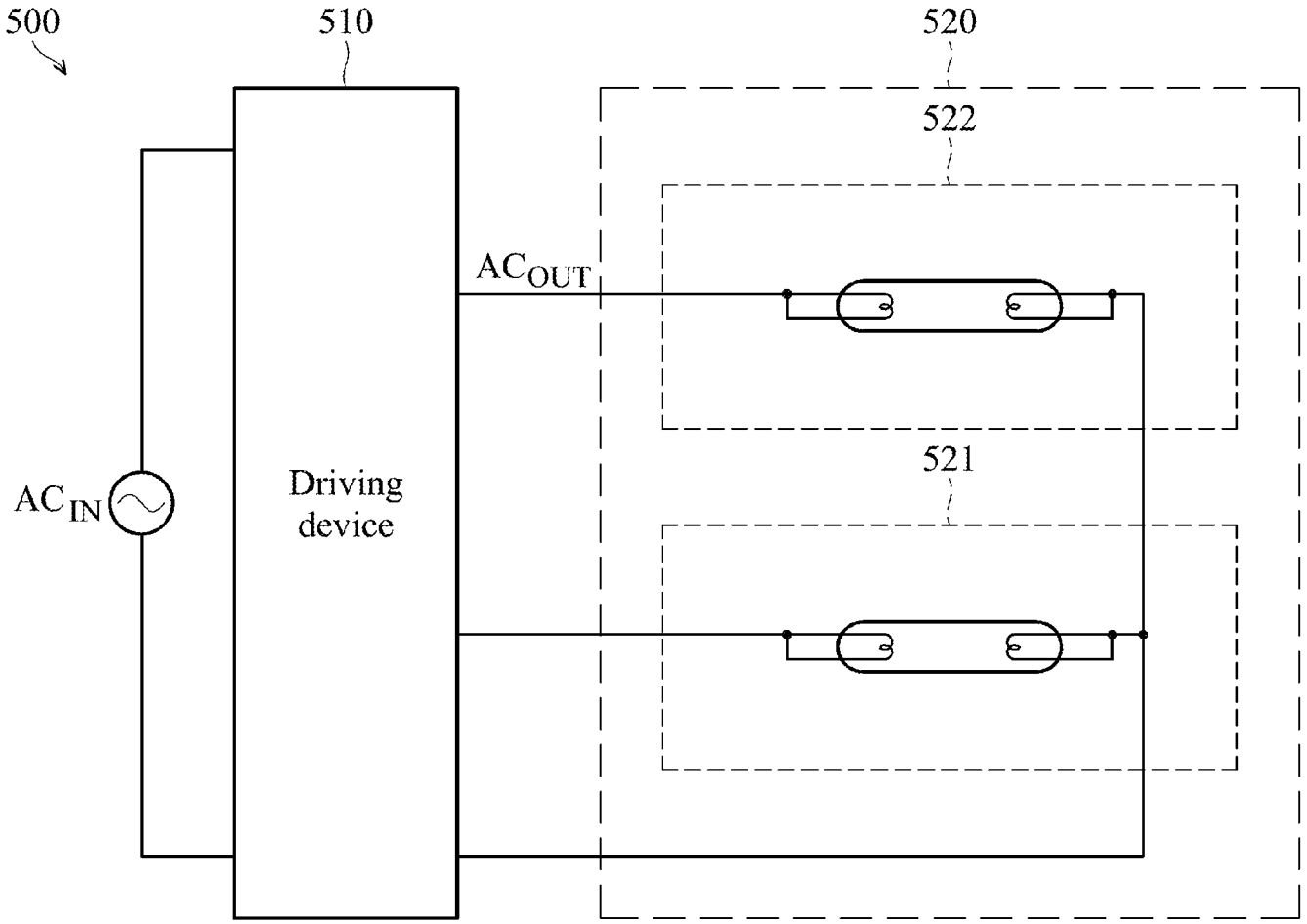

FIG. 5 is a schematic diagram of another exemplary embodiment of an illumination system, in accordance with some embodiments. The illumination system 500 comprises a driving device 510 and a load 520. The driving device 510 generates output power $AC_{OUT}$ to drive the load 520 according to input power $AC_{IN}$. In this embodiment, the load 520 comprises illumination devices 521 and 522. The illumination devices 521 and 522 are turned on according to the output power $AC_{OUT}$.

Figure 6:
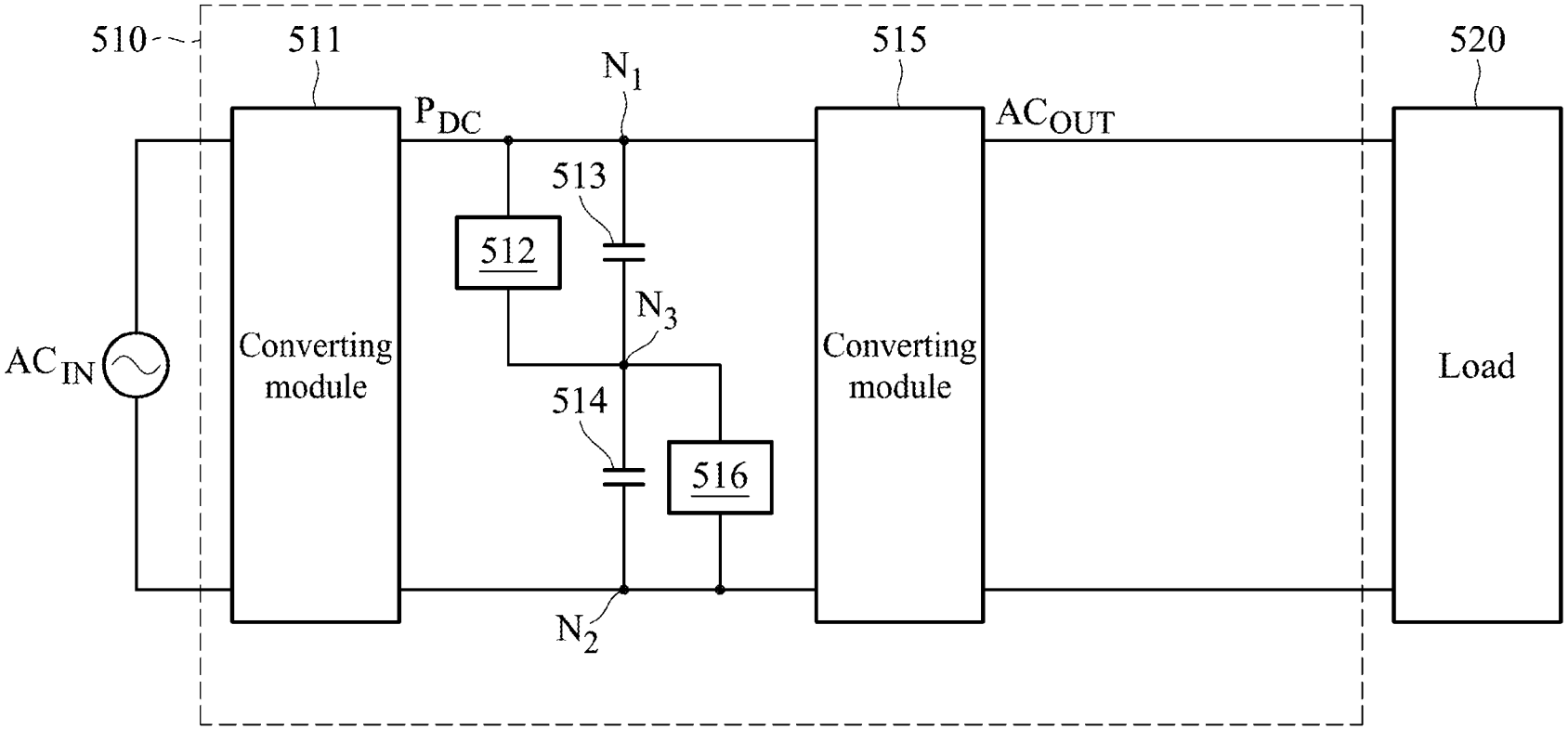

FIG. 6 is a schematic diagram of another exemplary embodiment of a driving device, in accordance with some embodiments. The driving device 510 comprises converting modules 511 and 515, capacitors 513 and 514, and clamping modules 512 and 516. Since the operations of the converting modules 511 and 515 are the same as the operations of the converting modules 211 and 215, the descriptions of the converting modules 511 and 515 are omitted. In this embodiment, the clamping module 512 is connected to the capacitor 513 in parallel, and the clamping module 516 is connected to the capacitor 514 in parallel.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A driving device providing output power to an illumination device comprising a plurality of filaments, comprising:

a first converting module converting input power into direct current (DC) power, wherein the first converting module comprises a pair of first input terminals receiving the input power and a pair of first output terminals coupled to a first node and a second node and outputting the DC power;

a first capacitor coupled between the first node and a third node;

a second capacitor coupled between the second and third nodes;

a first clamping module connected to a first specific capacitor in parallel, wherein the first specific capacitor is among the first and second capacitors; and a second converting module converting the DC power to generate the output power, wherein the second converting module comprises a second input terminal pair coupled to the first and second nodes and a second output terminal pair outputting the output power to light the illumination device, wherein the first capacitor is directly connected to the second capacitor.

2. The driving device as claimed in claim 1, wherein the first converting module is an AC-DC converter and has a power factor correction (PFC) function.

3. The driving device as claimed in claim 1, wherein the first clamping module is a transient voltage suppressor (TVS) or a metal oxide varistor (MOV).

4. The driving device as claimed in claim 1, wherein the capacitance values of the first and second capacitors are higher than 22 uF.

5. The driving device as claimed in claim 1, wherein the first and second capacitors are disposed in the first converting module.

6. The driving device as claimed in claim 1, wherein the output power is alternating current (AC) power with a high frequency.

7. The driving device as claimed in claim 1, further comprising:

a preheating module connected to a second specific capacitor in parallel and transferring energy stored in the second specific capacitor to preheat the filament, wherein the second specific capacitor is among the first and second capacitors.

8. The driving device as claimed in claim 1, further comprising:

a second clamping module connected to a second specific capacitor in parallel, wherein the second specific capacitor is among the first and second capacitors.

9. An illumination system comprising:

a first illumination device comprising a plurality of filaments and turned on according to output power;

a first converting module converting input power into direct current (DC) power, wherein the first converting module comprises a pair of first input terminals receiving the input power and a pair of first output terminals coupled to a first node and a second node and outputting the DC power;

a first capacitor coupled between the first node and a third node;

a second capacitor coupled between the second and third nodes;

a first clamping module connected to a first specific capacitor in parallel, wherein the first specific capacitor is among the first and second capacitors; and a second converting module converting the DC power to generate the output power, wherein the second converting module comprises a second input terminal pair coupled to the first and second nodes and a second output terminal pair outputting the output power to turn on the illumination device, wherein the first capacitor is directly connected to the second capacitor.

10. The illumination system as claimed in claim 9, further comprising:

a second illumination device connecting to the first illumination device in parallel and turned on according to the output power, wherein when the first illumination device is not turned on, the second illumination device is turned on according to the output power.

11. The illumination system as claimed in claim 9, wherein the first converting module is an AC-DC converter and has a power factor correction (PFC) function.

12. The illumination system as claimed in claim 9, wherein the first clamping module is a transient voltage suppressor (TVS) or a metal oxide varistor (MOV).

13. The illumination system as claimed in claim 9, wherein the capacitance values of the first and second capacitors are higher than 22 uF.

14. The illumination system as claimed in claim 9, wherein the output power is alternating current (AC) power with a high frequency.

15. The illumination system as claimed in claim 9, further comprising:

a preheating module connected to a second specific capacitor in parallel and transferring energy stored in the second specific capacitor to preheat the filament, wherein the second specific capacitor is among the first and second capacitors.

16. The illumination system as claimed in claim 9, further comprising:

a second clamping module connected to a second specific capacitor in parallel, wherein the second specific capacitor is among the first and second capacitors.

* * * * *